US011630412B2

(12) United States Patent
Kobayashi

(10) Patent No.: US 11,630,412 B2
(45) Date of Patent: Apr. 18, 2023

(54) IMAGE FORMING APPARATUS INCLUDING ELECTRICITY ELIMINATOR FOR ELIMINATING ELECTRICITY OF PHOTOSENSITIVE DRUM

(71) Applicant: KYOCERA Document Solutions Inc., Osaka (JP)

(72) Inventor: Kiyotaka Kobayashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/655,361

(22) Filed: Mar. 17, 2022

(65) Prior Publication Data

US 2022/0308520 A1 Sep. 29, 2022

(30) Foreign Application Priority Data

Mar. 26, 2021 (JP) ..... JP2021-053918

(51) Int. Cl.
*G03G 21/08* (2006.01)
*G03G 15/16* (2006.01)

(52) U.S. Cl.
CPC ..... *G03G 21/08* (2013.01); *G03G 15/1675* (2013.01)

(58) Field of Classification Search
CPC ..... G03G 21/08; G03G 15/1675
See application file for complete search history.

(56) References Cited

U.S. PATENT DOCUMENTS 9,535,356 B2 * 1/2017 Otani ..... G03G 15/0275
2011/0249987 A1 10/2011 Ishino et al.
2013/0195507 A1 * 8/2013 Morishita ..... G03G 15/169 399/128

FOREIGN PATENT DOCUMENTS

| | | | |
|---|---|---|---|
| JP | S644782 | A | 1/1989 |
| JP | H0273666 | A | 3/1990 |
| JP | H1184912 | A | 3/1999 |
| JP | 2003005535 | A | 1/2003 |
| JP | 2011221405 | A | 11/2011 |

* cited by examiner

*Primary Examiner* — Arlene Heredia
(74) *Attorney, Agent, or Firm* — Studebaker & Brackett PC

(57) ABSTRACT

An image forming apparatus includes a photosensitive drum, a charging roller, a development device, a transfer roller, a first electricity eliminator and a controller. The photosensitive drum is provided on a conveyance path along which a sheet is conveyed. The charging roller charges the photosensitive drum. The development device develops an electrostatic latent image formed on the photosensitive drum charged by the charging roller. The transfer roller faces the photosensitive drum across the conveyance path and generates a transfer bias. The first electricity eliminator irradiates the photosensitive drum with light on a downstream side of the development device in a rotational direction of the photosensitive drum and on an upstream side of the transfer roller in the rotational direction. The controller which controls the first electricity eliminator so as to irradiate only a non-sheet passing area of the photosensitive drum with the light.

7 Claims, 10 Drawing Sheets

IMAGE FORMING APPARATUS INCLUDING ELECTRICITY ELIMINATOR FOR ELIMINATING ELECTRICITY OF PHOTOSENSITIVE DRUM

INCORPORATION BY REFERENCE

This application is based on and claims the benefit of priority from Japanese patent application No. 2021-053918 filed on Mar. 26, 2021, which is incorporated by reference in its entirety.

BACKGROUND

The present disclosure relates to an image forming apparatus which forms an image in an electrophotographic manner.

In a process in which a toner image on a photosensitive drum is transferred to a sheet or an intermediate transfer belt, in order to stabilize a transfer electric field to obtain a suitable transfer performance, a voltage application to the transfer roller is generally subjected to a constant current control. However, when the image formed area (the exposed region) and the non-image formed area (the unexposed region) on the photosensitive drum are compared, the potential difference between the non-image formed area and the transfer roller is larger than the potential difference between the image-formed area and the transfer roller, so that a transfer current having a polarity opposite to that of the non-image formed area flows more larger to the non-image formed area and hardly flows to the image-formed area. Therefore, it is difficult to transfer fine pixels, which causes an obstacle on high image quality. As a means for avoiding this problem, it is conceivable to increase the transfer current to increase the transfer performance, but when the transfer current is increased, the difference in the amount of the transfer current flowing into the image formed area and the non-image formed area increases, so that the residual charge in the non-image formed area increases and a transfer memory (color graduation indicating the transfer history) occurs on the subsequent image. In recent years, in a charge device, a corona discharge type is shifted to a charge roller type that generates less ozone, but in the case of the charge roller type, a transfer memory tends to appear more remarkably than the corona discharge type.

Then, a technique to improve the erasing ability of the photosensitive drum has been discussed. For example, in a tandem type color image forming apparatus using an intermediate transfer belt, an erasing light source disposed between a primary transfer area and a cleaning part is used as a pre-transfer erasing light source of an image forming unit disposed adjacently in a rotational direction of the intermediate transfer belt. Further, in some cases, a photosensitive drum is irradiated with the erasing light transmitted through the sheet on the upstream side of the transfer device in the transfer direction or at the same position as the transfer device.

The potential difference between the image formed area and the non-image formed area acts on a restraining force for a toner, but if the potential difference becomes small, the restraining force becomes small, and toner scattering (the scattering of the toner from the image formed area to the non-image formed area) may easily occur. When the sheet-passing area (an area in contact with the sheet at the transferring) is irradiated with light, the potential of the non-image formed area in the sheet-passing area is decreased, and the toner scattering may easily occur.

In the above configurations, in a case where the toner image is directly transferred to the sheet without an intermediate transfer member, the transfer current flows to the non-sheet passing area (the area not in contact with the sheet at the transferring) larger than to the sheet passing area, and it becomes difficult to control the transfer current or a potential drop may occur owing to the transfer memory. The larger the potential of the non-sheet passing area is, the stronger the tendency is. For example, in a case where the potential is 500 V at the development position, when the potential of the non-sheet passing area is larger than that of the image formed area by 150 V or more, the deterioration in the transfer performance ability becomes remarkable. When the transfer current is increased in order to improve the transfer performance, the transfer memory becomes thick.

Further, in the above configuration, it is necessary to increase an amount of light in order to obtain an erasing effect on the non-sheet passing area of the photosensitive drum. In this case, there is a problem that deterioration of the photosensitive drum in the non-sheet passing area is accelerated. Further, in the case of the charge roller system (particularly, DC charging), potential unevenness easily occurs.

SUMMARY

In accordance with an aspect of the present disclosure, an image forming apparatus includes a photosensitive drum, a charging roller, a development device, a transfer roller, a first electricity eliminator and a controller. The photosensitive drum is provided on a conveyance path along which a sheet is conveyed. The charging roller charges the photosensitive drum. The development device develops an electrostatic latent image formed on the photosensitive drum charged by the charging roller. The transfer roller faces the photosensitive drum across the conveyance path and generates a transfer bias. The first electricity eliminator irradiates the photosensitive drum with light on a downstream side of the development device in a rotational direction of the photosensitive drum and on an upstream side of the transfer roller in the rotational direction. The controller which controls the first electricity eliminator so as to irradiate only a non-sheet passing area of the photosensitive drum with the light.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, a printer 1 (an example of an image forming apparatus) according to one embodiment in the present disclosure will be described.

Figure 1:
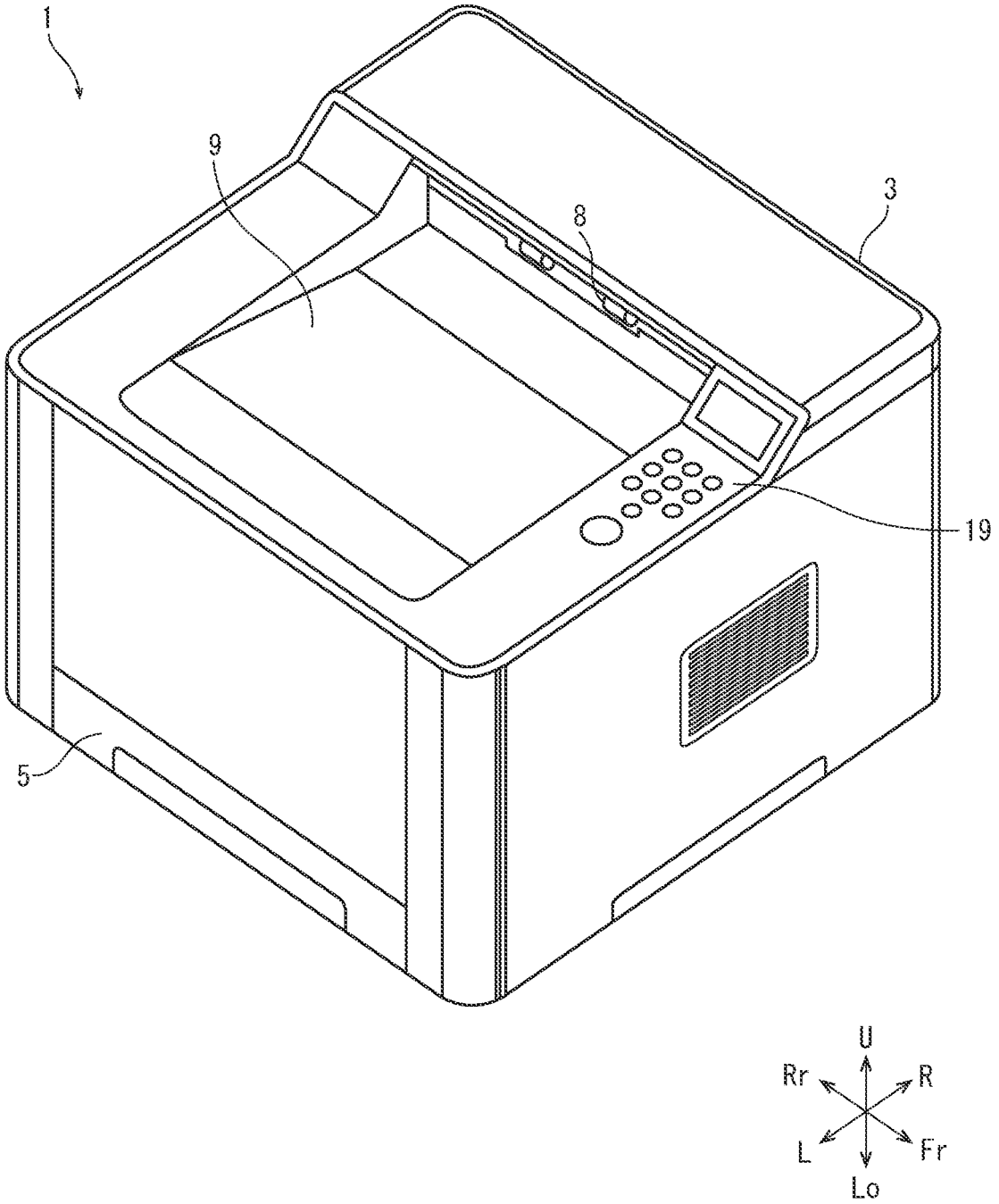
FIG. 1 is a view showing an external appearance of a printer according to one embodiment of the present disclosure.
Figure 2:
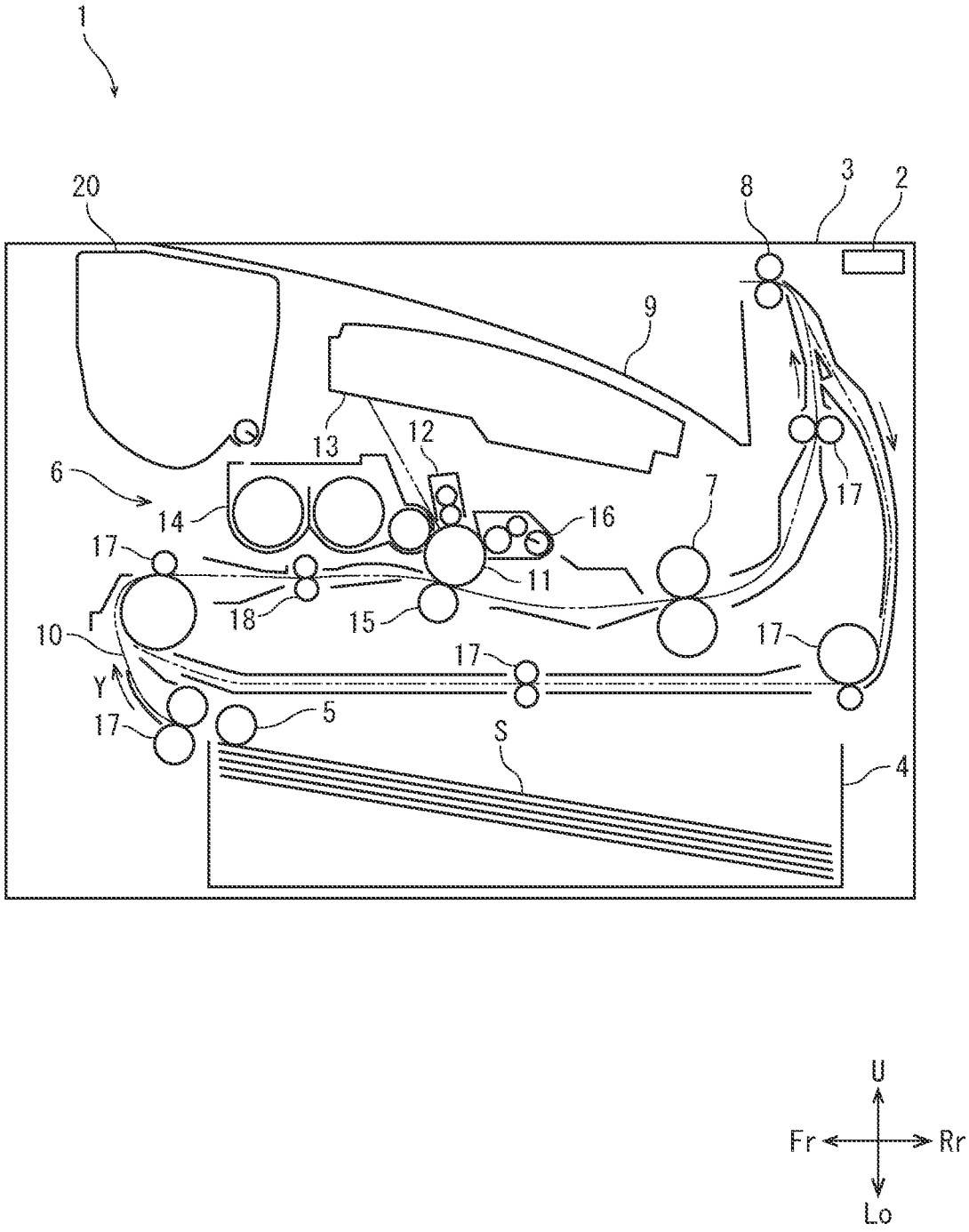
FIG. 2 is a right side view schematically showing an inner structure of the printer according to the embodiment of the present disclosure.

First, the entire structure of the printer 1 will be described. FIG. 1 is a perspective view schematically showing the external appearance of the printer 1. FIG. 2 is a right side view schematically showing the internal structure of the printer 1. Hereinafter, the left side of the paper surface on which FIG. 2 is drawn is defined as the front side of the printer 1, and the left-and-right direction will be described with reference to a direction in which the printer 1 is viewed from the front side. In each of the drawings, U, Lo, L, R, Fr, and Rr indicate upper, lower, left, right, front, and rear, respectively.

The printer 1 includes a rectangular parallelepiped housing 3. In the lower portion of the inside of the housing 3, a sheet feeding feed cassette 4 in which a sheet S is stored and a sheet feeding roller 5 which feeds the sheet S from the sheet feeding cassette 4 are provided. An image forming device 6 which forms a toner image on the sheet by an electrophotographic method is provided above the sheet feeding cassette 4, and a fixing device 7 which fixes the toner image to the sheet S is provided behind the image forming device 6. Above the fixing device 7, a sheet discharge roller 8 which discharges the sheet S on which the toner image is fixed and a sheet discharge tray 9 on which the discharged sheet S is stacked are provided.

A conveyance path 10 from the sheet feeding roller 5 to the sheet discharge roller 8 via the image forming device 6 and the fixing device 7 is provided inside the housing 3. The conveyance path 10 is formed of plate-like members facing each other with a gap for passing the sheet S, and conveyance rollers 17 for holding and conveying the sheet S are provided at a plurality of positions along the conveyance direction Y. A registration roller 18 is provided on the upstream side of the image forming device 6 in the conveyance direction.

The image forming device 6 includes: a photosensitive drum 11 whose potential changes by irradiation of light; a charging roller 12 which charges the photosensitive drum 11; an exposure device 13 which emits laser light corresponding to image data; a development device 14 which supplies toner to the photosensitive drum 11; a transfer roller 15 which generates transfer bias; and a cleaning device 16 which removes the toner remaining on the photosensitive drum 11. A toner container 20 which supplies the toner to the development device 14 is connected to the development device 14.

As an example, the photosensitive drum 11 includes a positive charge type photoreceptor. The charging roller 12 is a positive DC (Direct Current) charging roller, and positively charges the photosensitive drum 11. The development device 14 positively charges the toner. The transfer roller 15 generates a negative transfer bias. The toner is a magnetic toner. The positive charge type image forming device 6 has an advantage of less ozone generation than the negative charge type. It should be noted that the present disclosure may be applied to the printer 1 whose polarity of charge and transfer bias is opposite to those of the above-described ones. The present disclosure may also be applied to the printer 1 including an AC (Alternating Current) charging roller and the printer 1 using a non-magnetic toner.

A controller 2 includes an arithmetic part and a storage part. The arithmetic part is a central processing unit (CPU), for example. The storage part includes a storage medium such as a ROM (Read Only Memory), a RAM (Random Access Memory), and an EEPROM (Electrically Erasable Programmable Read Only Memory). The arithmetic part reads and executes the control program stored in the storage part to execute various processes. The controller 2 may be implemented by an integrated circuit that does not use software.

An operation panel 19 is provided on the right side portion of the upper surface of the housing 3. The operation panel 19 includes a display panel and a keypad adjacent to the display panel. The controller 2 displays a screen showing an operation menu, a status of the printer 1 and the others on the display panel, and controls each part of the printer 1 according to an operation detected by a keypad.

The basic image forming operation of the printer 1 is as follows. When a print job of single-side printing is inputted to the printer 1 from an external computer or the like, the sheet feeding roller 5 feeds the sheet S from the sheet feeding cassette 4 to the conveyance path 10, the registration roller 18 whose rotation is stopped corrects skew of the sheet S, and the registration roller 18 feeds the sheet S to the image forming device 6 at predetermined timing. In the image forming device 6, the charging roller 12 charges the photosensitive drum 11 to a predetermined potential, the exposure device 13 writes an electrostatic latent image on the photosensitive drum 11, the development device 14 forms a toner image by developing the electrostatic latent image using the toner supplied from the toner container 20, and the transfer roller 15 transfers the toner image to the sheet S. Subsequently, the fixing device 7 fuses the toner image while holding and conveying the sheet S, thereby fixing the toner image on the sheet S, and the sheet discharge roller 8 discharges the sheet S to the sheet discharge tray 9.

Figure 3:
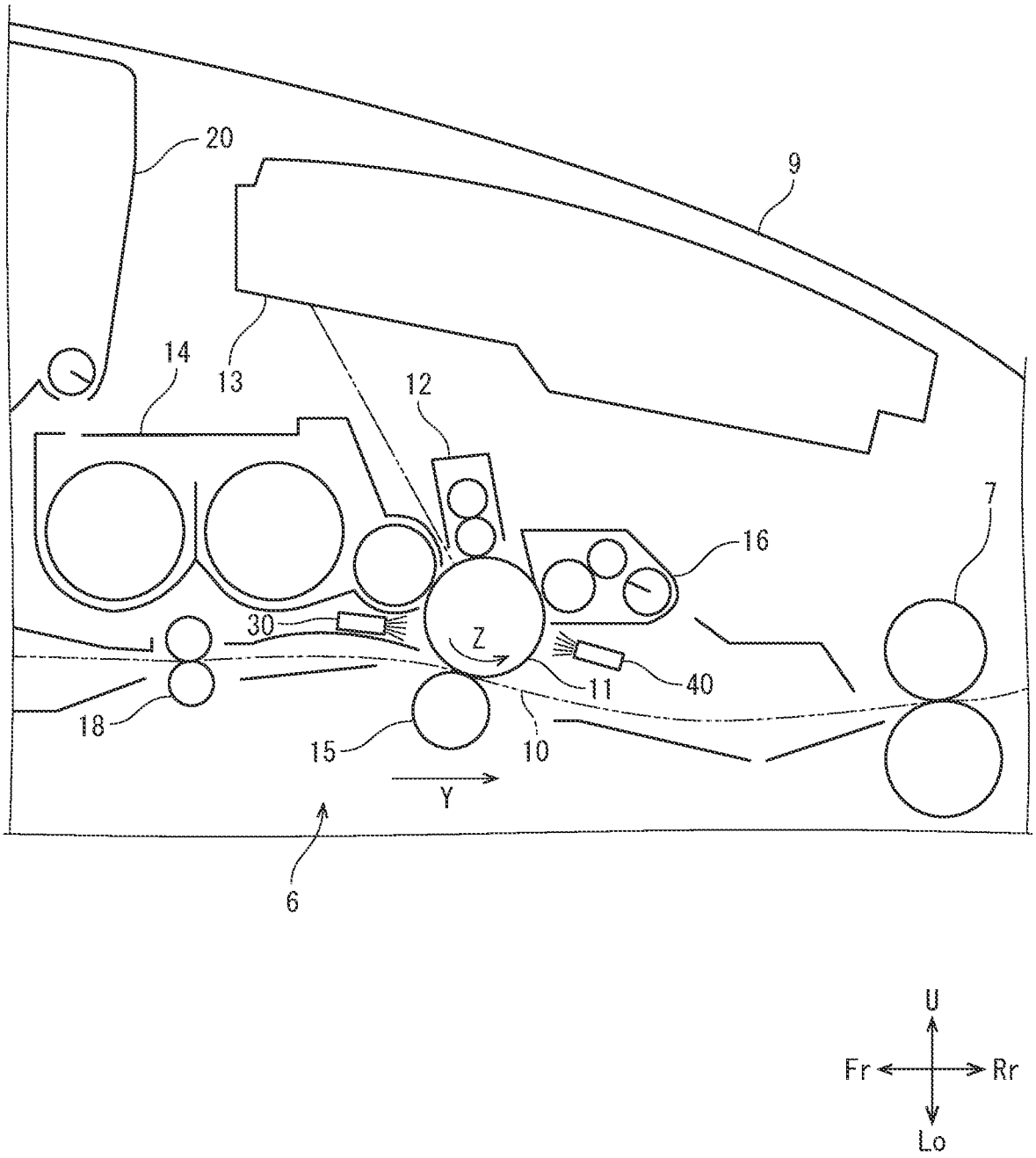
FIG. 3 is a right side view schematically showing an image forming device according to the embodiment of the present disclosure.
Figure 4:
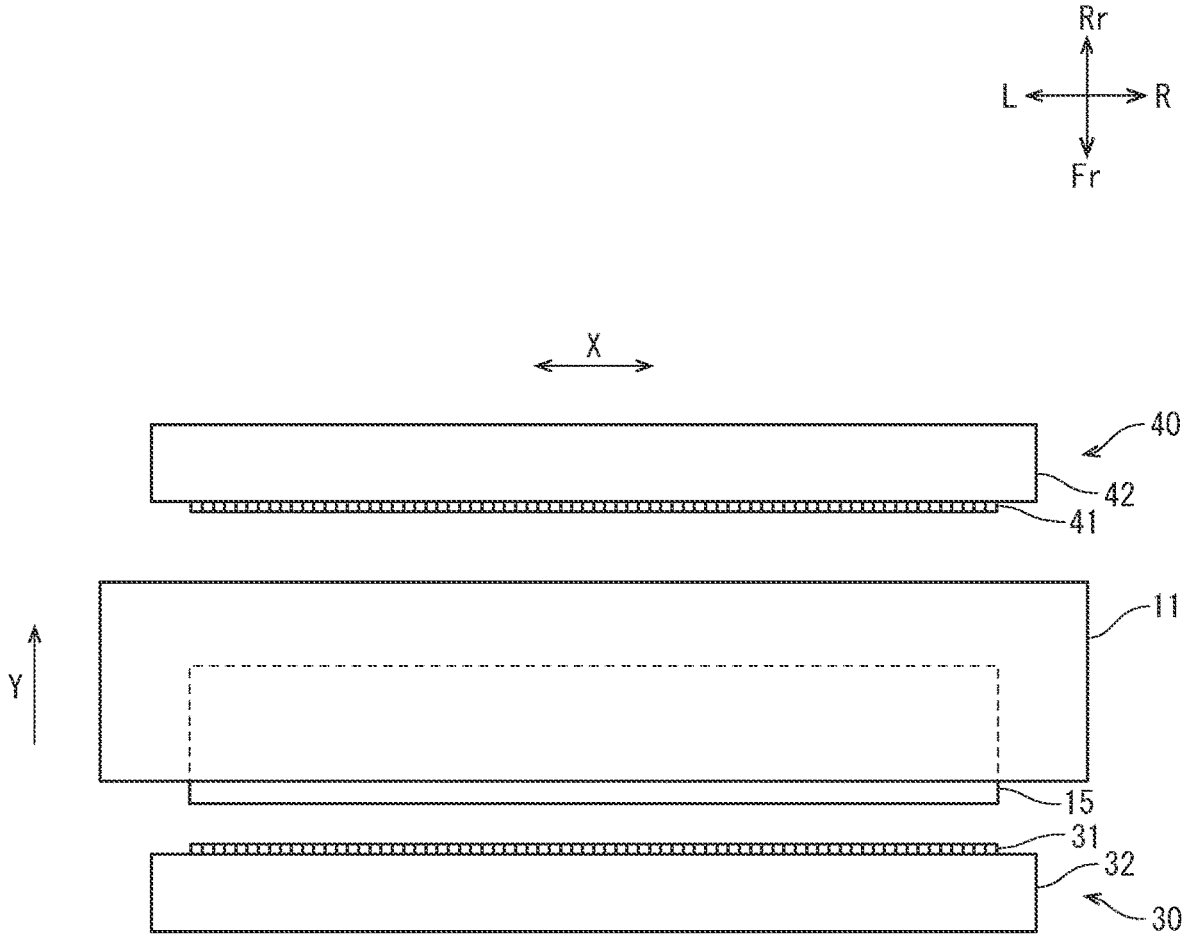
FIG. 4 is a plan view schematically showing a first electricity eliminator, a second electricity eliminator, a photosensitive drum and a transfer roller according to the embodiment of the present disclosure.

Next, a configuration related to electricity elimination of the photosensitive drum 11 will be described. FIG. 3 is a right side view schematically showing the structure of the image forming device 6. FIG. 4 is a plan view schematically showing a first electricity eliminator 30, a second electricity eliminator 40, the photosensitive drum 11, and the transfer roller 15.

The printer 1 includes the photosensitive drum 11, the charging roller 12, the development device 14, the first electricity eliminator 30 and the controller the transfer roller 15, the first electricity eliminator 30 and the controller 2. The photosensitive drum 11 is provided on the conveyance path 10 along which the sheet S is conveyed. The charging roller 12 charges the photosensitive drum 11. The development device 14 develops the electrostatic latent image formed on the photosensitive drum 11 charged by the charging roller 12 using the toner. The transfer roller 15 faces the photosensitive drum 11 across the conveyance path 10, and generates the transfer bias. The first electricity eliminator 30 irradiates the photosensitive drum 11 with light on the downstream side of the development device 14 in the rotational direction Z of the photosensitive drum 11 and on the upstream side of the transfer roller 15 in the rotational direction Z. The controller 2 controls the first electricity eliminator 30 so as to irradiate only a non-sheet passing area of the photosensitive drum 11 with the light.

[First Electricity Eliminator] The first electricity eliminator 30 includes a plurality of light sources 31 arranged in a width direction X crossing the conveyance direction Y, and a housing 32 whose longitudinal direction is along the width direction X. The light source 31 is an LED (Light Emitting Diode), for example, stored in the housing 32 and exposed through one surface of the housing 32. In the example of FIG. 4, the seventy two (72) light sources 31 are arranged in a row along the width direction X, but any number of light sources 31 may be provided and a plurality of rows of the light sources 31 may be provided. The first electricity eliminator 30 is disposed on the downstream side of the development device 14 in the rotational direction Z of the photosensitive drum 11 and above the conveyance path 10 on the upstream side of the transfer area of the transfer roller 15 in the conveyance direction Y, and is fixed to the housing 3 with the light sources 31 facing the photosensitive drum 11.

Figure 5:
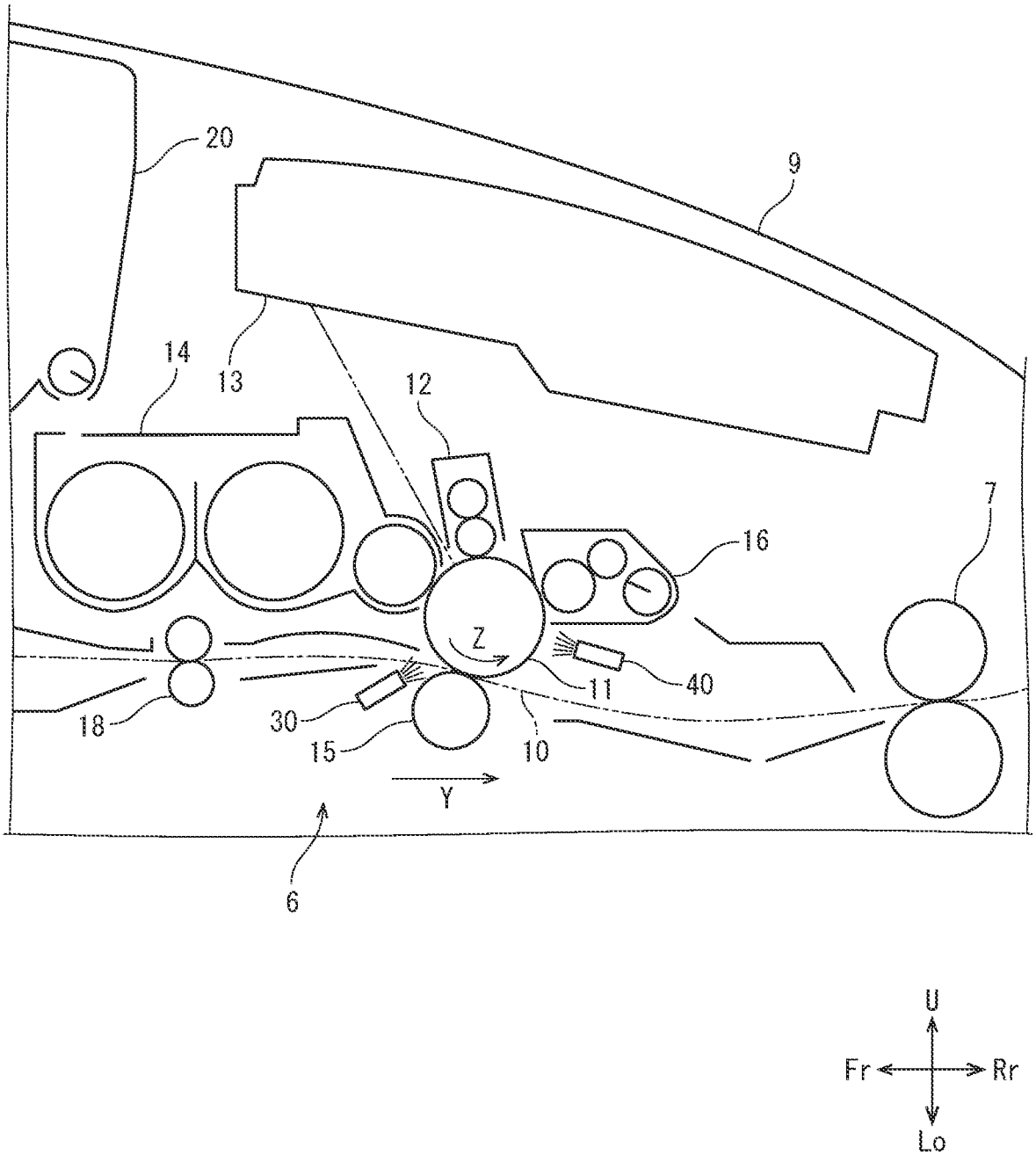
FIG. 5 is a right side view schematically showing the structure of the image forming device according to the present disclosure.

The first electricity eliminator 30 may be disposed below the conveyance path 10 on the upstream side of the transfer area of the transfer roller 15 in the conveyance direction Y. FIG. 5 is a right side view schematically showing the structure of the image forming device 6. In this case, the member forming the conveyance path 10 is disposed so as to avoid the irradiation range of the light sources 31 so that the light emitted from the light sources 31 reaches the photosensitive drum 11. In other words, the first electricity eliminator 30 according to the present embodiment irradiates the photosensitive drum 11 with the light on the downstream side of the development device 14 in the rotational direction Z of the photosensitive drum 11 and on the upstream side of the transfer roller 15 in the rotational direction Z.

[Second Electricity Eliminator] A second electricity eliminator 40 includes a plurality of light sources 41 arranged in a width direction X crossing the conveyance direction Y, and a housing 42 whose longitudinal direction is along the width direction X. The light source 41 is an LED, for example, and is exposed from one surface of the housing 42. In the example of FIG. 4, the seventy two (72) light sources 41 are arranged in a row in the width direction X, but any number of light sources 41 may be provided and a plurality of rows of light sources 41 may be provided. The second electricity eliminator 40 is disposed on the downstream side of the transfer area of the transfer roller 15 in the rotation direction Z of the photosensitive drum 11 and above the conveyance path 10. Further, the second electricity eliminator 40 is disposed on the upstream side of the cleaning device 16 in the rotation direction Z. The second electricity eliminator 40 is fixed to the housing 3 with the light sources 41 facing the photosensitive drum 11.

The second electricity eliminator 40 may be disposed on the downstream side of the cleaning device 16 in the rotational direction Z and on the upstream side of the charging roller 12 in the rotational direction Z. In other words, the second electricity eliminator 40 according to the present embodiment irradiates the photosensitive drum 11 with the light on the downstream side of the conveyance path 10, where is on the downstream side of the transfer area of the transfer roller 15 in the conveyance direction Y, in the rotational direction Z of the photosensitive drum 11 and on the upstream side of the charging roller 12 in the rotational direction Z.

The controller 2 controls a quantity of light of the first electricity eliminator 30 and the second electricity eliminator 40. More specifically, in order to stabilize the potential of the photosensitive drum 11 at the time of recharging after the transfer of the toner image, it is necessary to set at least a quantity of light such that no charge remains on the photosensitive drum 11. However, when an LED is used as the light sources 31, since the light of the LED has no directivity, the light of the light sources 31 facing the non-sheet passing area is also irradiated to the sheet passing area. Therefore, in the case where the first electricity eliminator 30 is provided above the conveyance path 10 (see FIG. 3), the potential of the non-image formed area of the sheet passing area decreases, and the toner scattering may occur. Further, in the case where the first electricity eliminator 30 is provided below the conveyance path 10 (see FIG. 5), the light may pass through the sheet S depending on the quantity of light of the first electricity eliminator 30, and even in this case, the toner scattering may occur. Therefore, the controller 2 controls the quantity of light of the first electricity eliminator 30 to be smaller than that of the second electricity eliminator 40.

More specifically, in the case where the first electricity eliminator 30 is provided below the conveyance path 10 (see FIG. 5), the controller 2 controls the quantity of light of the first electricity eliminator 30 to a quantity of light that does not pass through the thinnest printing sheet among the printing sheets that can be used for the image forming operation using the printer 1, or a quantity of light that is smaller than the half decay exposure (the quantity of light required to halve the potential) of the photosensitive drum 11 even if the light passes through. Regardless of whether the position of the first electricity eliminator 30 is above or below the conveyance path 10, the controller 2 controls the quantity of light of the first electricity eliminator 30 to the non-sheet passing area to ⅓ or more of the half decay exposure of the photosensitive drum 11.

For example, when the potential of the photosensitive drum 11 at the developing position of the development device 14 is set to 500 V, the controller 2 controls the quantity of light of the first electricity eliminator 30 so that the potential of the non-sheet passing area of the photosensitive drum 11 becomes lower by 50 to 300 V than the non-image formed area of the sheet passing area before the transfer process by the transfer roller 15.

In this embodiment, the length of the transfer roller 15 in the width direction X is less than the maximum length of the sheet S in the width direction X. The maximum length of the sheet S in the width direction X is the length of the long side of the sheet of A4 size, for example. The reason for this configuration is that, when the sheet S having the largest length in the width direction X is used, the sheet S is interposed between the transfer roller 15 and the photosensitive drum 11 over the entire area of the transfer roller 15 in the width direction X, so that the transfer current does not flow into the non-sheet passing area, and the electricity elimination of the non-sheet passing area becomes unnecessary.

Next, the operation of the printer 1 will be described. In any of the following cases, the controller 2 turns on at least the second electricity eliminator 40.

Figure 6:
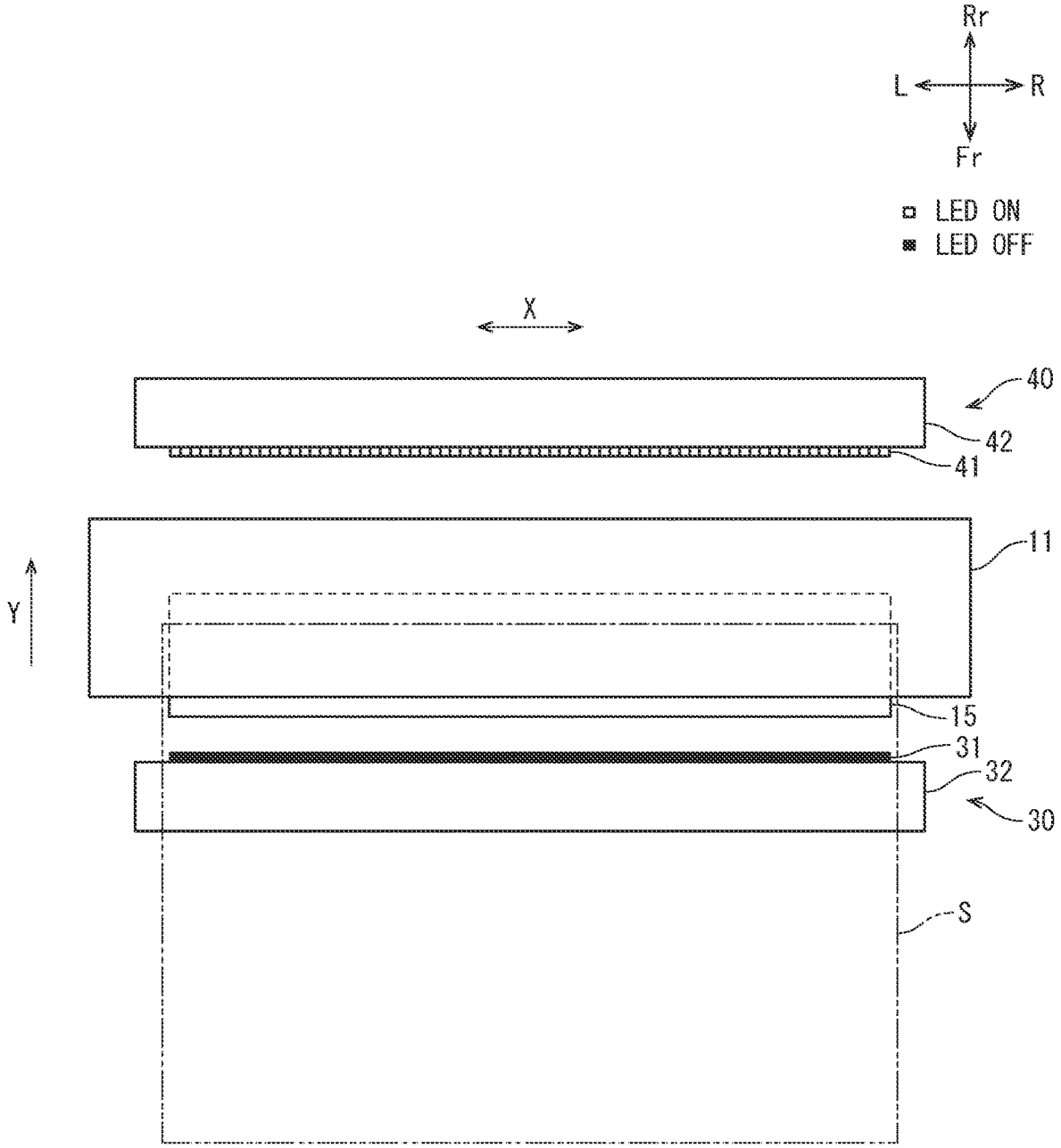
FIG. 6 is a plan view showing an operation in which a sheet having a length longer than a transfer roller in a width direction is conveyed, in the embodiment of the present disclosure.

FIG. 6 is a plan view showing an operation when the sheet S having a length longer than the transfer roller 15 in the width direction X is conveyed. Here, an example is shown, in which the long side of the sheet of A4 size is set perpendicular to the conveyance direction Y and then conveyed. In this case, as described above, the electricity elimination of the non-sheet passing area is unnecessary. Therefore, the controller 2 does not turn on the first electricity eliminator 30. On the other hand, the controller 2 turns on the second electricity eliminator 40.

Figure 7:
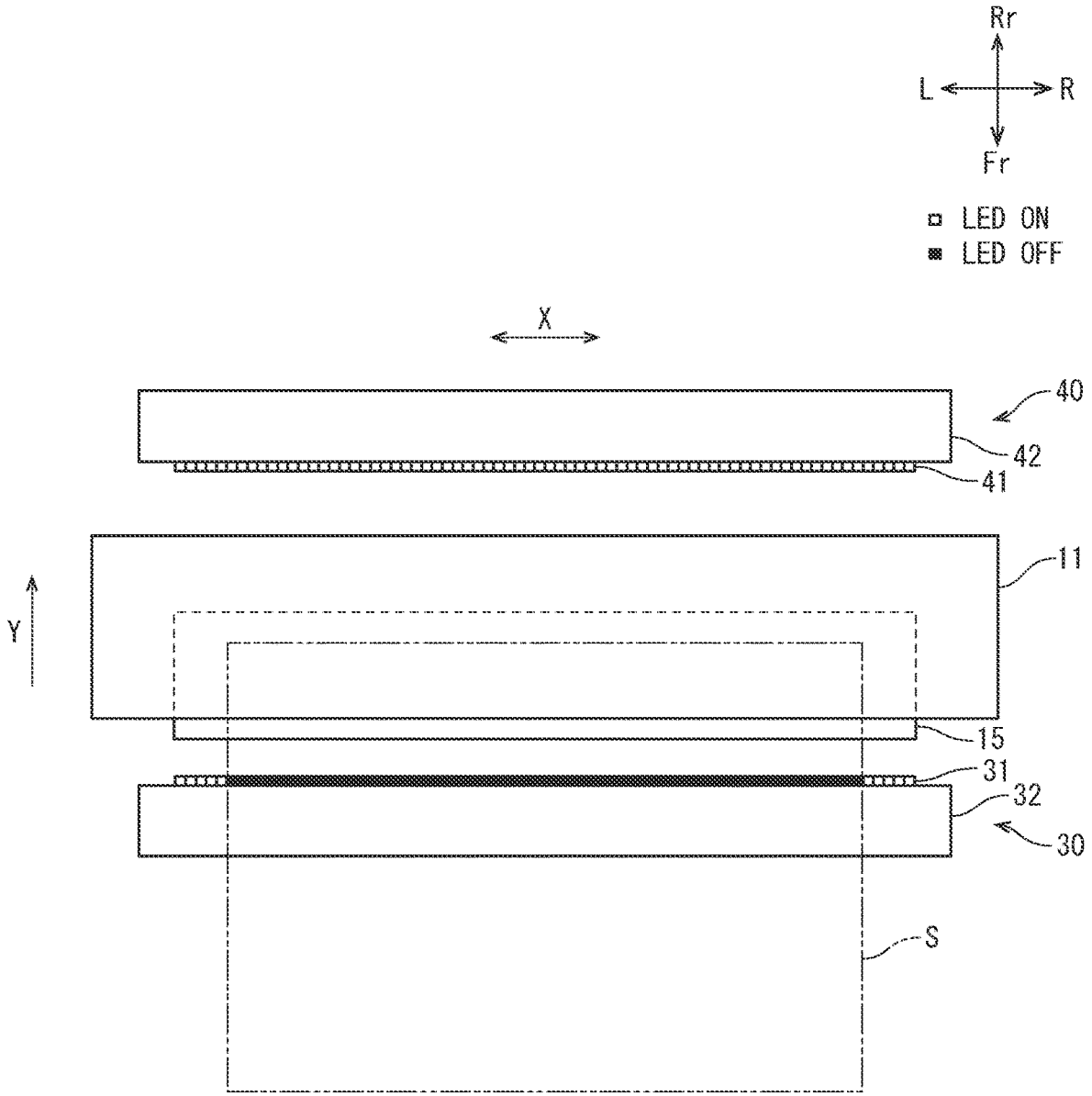
FIG. 7 is a plan view showing the operation in which the sheet having a length longer than the transfer roller in a width direction is conveyed, in the embodiment of the present disclosure.
Figure 8:
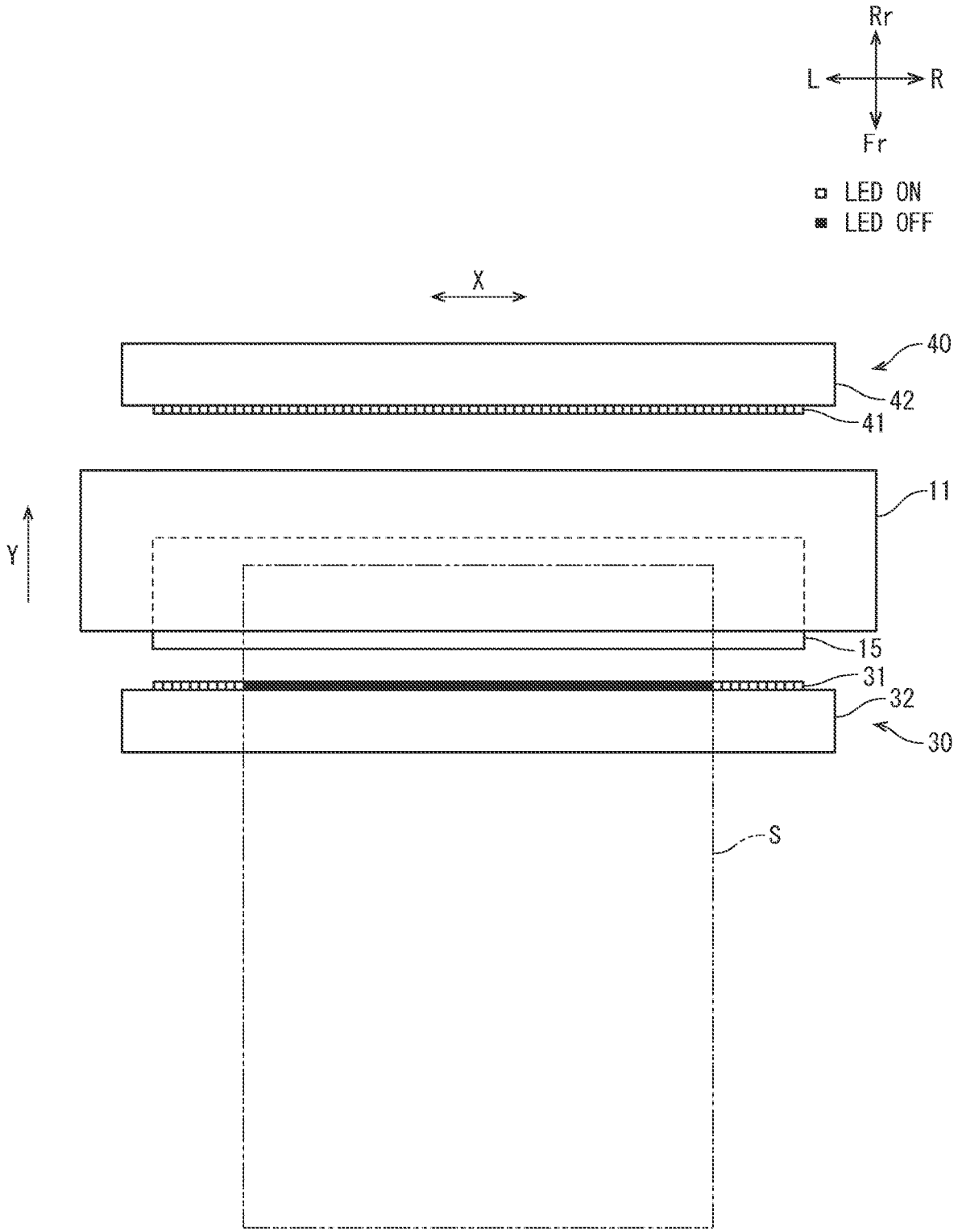
FIG. 8 is a plan view showing the operation in which the sheet having a length longer than the transfer roller in a width direction is conveyed, in the embodiment of the present disclosure.

FIG. 7 and FIG. 8 are plan views showing an operation when the sheet S having a length shorter than the transfer roller 15 in the width direction X is conveyed. FIG. 7 shows an example in which the long side of the sheet S of JIS (Japanese Industrial Standards) B5 size is set perpendicular to the conveyance direction Y and then conveyed. FIG. 8 shows an example in which the short side of the sheet S of A4 size is set perpendicular to the conveyance direction Y and then conveyed.

The controller 2 controls the first electricity eliminator 30 so as to irradiate only the non-sheet passing area of the photosensitive drum 11 with the light. Specifically, the controller 2 specifies the sheet passing area and the non-sheet passing area from the size of the sheet S indicated by the print job input to the printer 1, and turns on only the light sources 31 facing the non-sheet passing area. In the example of FIG. 7, of the seventy two (72) light sources 31 provided in the first electricity eliminator 30, the light sources 31 from the right and left ends to the fifth light sources are turned on, and the remaining sixty two (62) light sources 31 are not turned on. In the example of FIG. 8, the light sources 31 from the left and right ends to the tenth light sources are turned on, and the remaining fifty two (52) light sources 31 are not turned on. In either case, since the electricity of the sheet passing area is not eliminated, a decrease in the potential of the non-image formed area of the sheet passing area is suppressed, and the toner scattering is suppressed. On the other hand, since the electricity of the non-sheet passing area is eliminated and the potential is decreased, even if the transfer current is increased, the flow of the transfer current into the non-image formed area through the non-sheet passing area is suppressed, and the transfer memory is suppressed.

The printer 1 according to the embodiment described above includes the photosensitive drum 11, the charging roller 12, the development device 14, the first electricity eliminator 30 and the controller 2. The photosensitive drum 11 is provided on the conveyance path 10 along which the sheet S is conveyed. The charging roller 12 charges the photosensitive drum 11. The development device 14 develops the electrostatic latent image formed on the photosensitive drum 11 charged by the charging roller 12 using the toner. The transfer roller 15 which faces the photosensitive drum 11 across the conveyance path 10 and generates a transfer bias. The first electricity eliminator 30 irradiates the photosensitive drum 11 with the light on the downstream side of the development device 14 in the rotational direction Z of the photosensitive drum 11 and on the upstream side of the transfer roller 15 in the rotational direction Z. The controller 2 controls the first electricity eliminator 30 to irradiate only the non-sheet passing area of the photosensitive drum 11 with the light.

According to this configuration, since the electricity of the sheet passing area is not eliminated, a decrease in the potential of the non-image formed area of the sheet passing area is suppressed, and the toner scattering is suppressed. On the other hand, since the electricity of the non-sheet passing area is eliminated and the potential is decreased, even if the transfer current is increased, the flow of the transfer current into the non-image formed area through the non-sheet passing area is suppressed, and the transfer memory is suppressed. When the sheet S having a length equal to or larger than a length of the transfer roller 15 in the width direction X is conveyed, since the sheet S is interposed between the transfer roller 15 and the photosensitive drum 11 over the entire area of the transfer roller 15 in the width direction X, the transfer current does not flow into the non-sheet passing area, and therefore, the electricity elimination of the non-sheet passing area is not needed. Therefore, according to the present embodiment, the transfer performance can be improved while suppressing the toner scattering and the transfer memory.

According to the printer 1 according to the present embodiment, the first electricity eliminator 30 includes a plurality of light sources 31 arranged in the width direction X crossing the conveyance direction Y, and the controller 2 turns on only the light sources 31 facing the non-sheet passing area corresponding to the size of the conveyed sheet S among the light sources 31, so that it becomes possible to irradiate the non-sheet passing area with the light depending on the size of the conveyed sheet S.

In addition, the printer 1 according to the present embodiment includes the second electricity eliminator 40 which irradiates the photosensitive drum 11 with the light on the downstream side of the conveyance path 10, where is on the downstream side of the transfer area of the transfer roller 15 in the conveyance direction Y, in the rotational direction A of the photosensitive drum 11 and on the upstream side of the charging roller 12 in the rotational direction Z, and the quantity of light of the first electricity eliminator 30 is smaller than that of the second electricity eliminator 40, so that the action of the electricity elimination on the sheet passing area by the first electricity eliminator 30 can be suppressed and the toner scattering can be suppressed.

Further, according to the printer 1 according to the present embodiment, the controller 2 controls the quantity of light of the first electricity eliminator 30 such that the potential of the non-sheet passing area of the photosensitive drum 11 is lower than that of the non-image formed area of the sheet passing area before the transfer process by the transfer roller 15. Therefore, the flow of the transfer current to the non-image formed area through the non-sheet passing area can be suppressed.

The above embodiment may be modified as follows.

Figure 9:
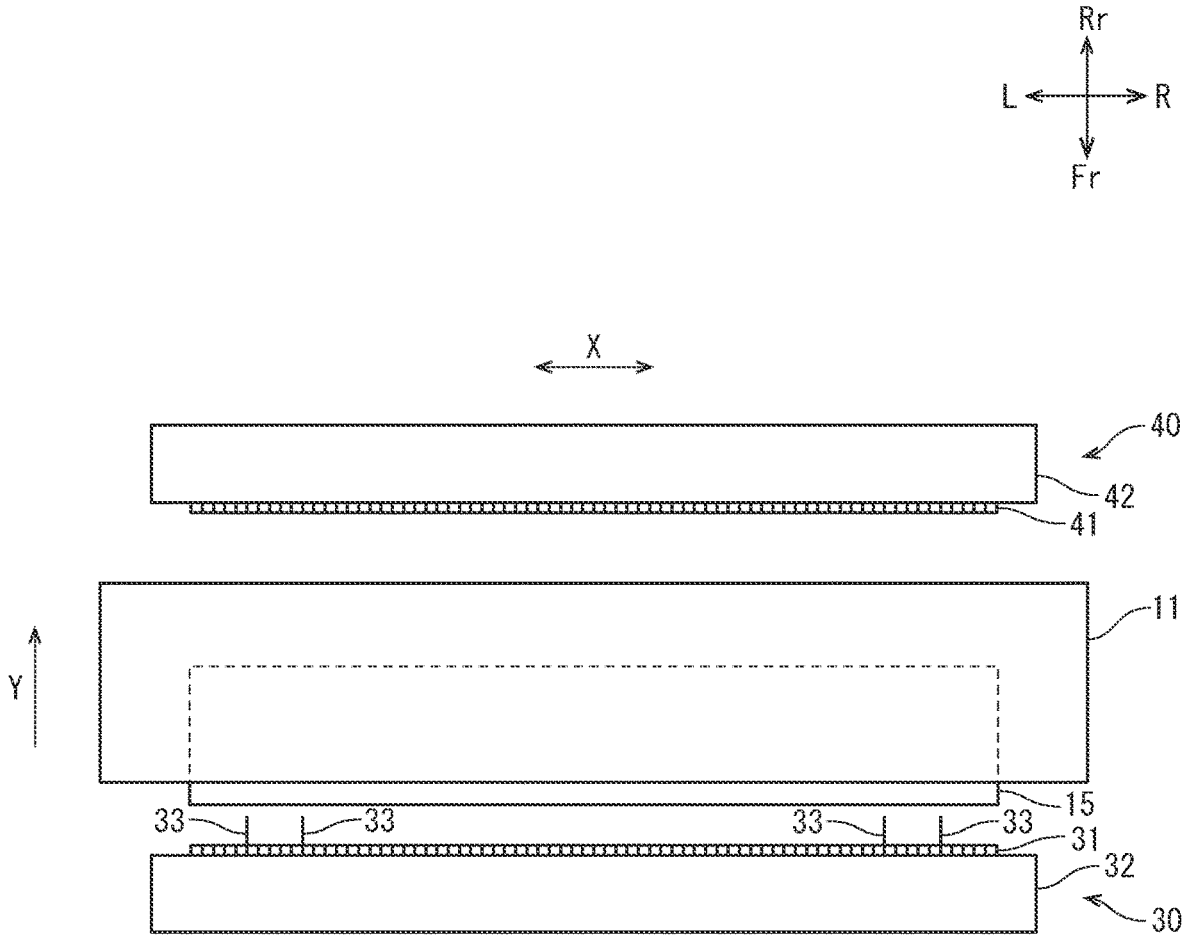
FIG. 9 is a plan view schematically showing a first electricity eliminator, a second electricity eliminator, a photosensitive drum and a transfer roller according to a modified example of the embodiment of the present disclosure.
Figure 10:
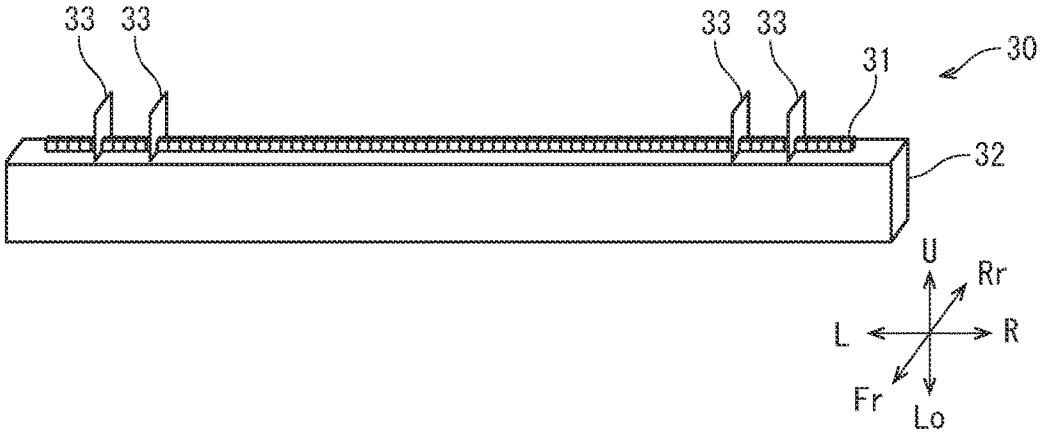
FIG. 10 is a perspective view showing a first electricity eliminator according to the modified example of the embodiment of the present disclosure.

In the above embodiment, an LED is used as the light source 31, but since the light of the LED has no directivity, even if only the light source 31 facing the non-sheet passing area is turned on, the sheet passing area is also irradiated with the light. Therefore, in addition to the configuration of the above embodiment, the following configuration may be provided. FIG. 9 is a plan view schematically showing the first electricity eliminator 30, the second electricity eliminator 40, the photosensitive drum 11, and the transfer roller 15 according to a modified example. FIG. 10 is a perspective view showing the first electricity eliminator 30 according to the modified example. In this example, a light shielding member 33 is provided on the surface of the housing 32 of the first electricity eliminator 30 on which the light sources 31 are provided. The light shielding member 33 is a plate-like member, and is provided at a position corresponding to a boundary portion between the sheet passing area and the non-sheet passing area in the example of FIG. 7 and a boundary portion between the sheet passing area and the non-sheet passing area in the example of FIG. 8. According to this configuration, since the light shielding member 33 blocks the light to the sheet passing area when only the light sources 31 facing the non-sheet passing area are turned on, the toner scattering due to a decrease in the potential of the non-image formed area of the sheet passing area can be suppressed.

The above embodiment shows an example in which the length of the transfer roller 15 in the width direction X is less than the maximum length of the sheet S in the width direction X, but the length of the transfer roller 15 in the width direction X may be equal to or longer than the maximum length of the sheet S in the width direction X. According to this configuration, since the margin in the width direction X does not need to be enlarged, the limitation of the size of the image can be avoided. Further, foreign matter can be prevented from adhering to the end of portion the sheet S.

The above embodiment shows an example in which the light sources 31 and 41 are LEDs, but the light sources 31 and 41 may be halogen lamps or the like.

Figure 11:
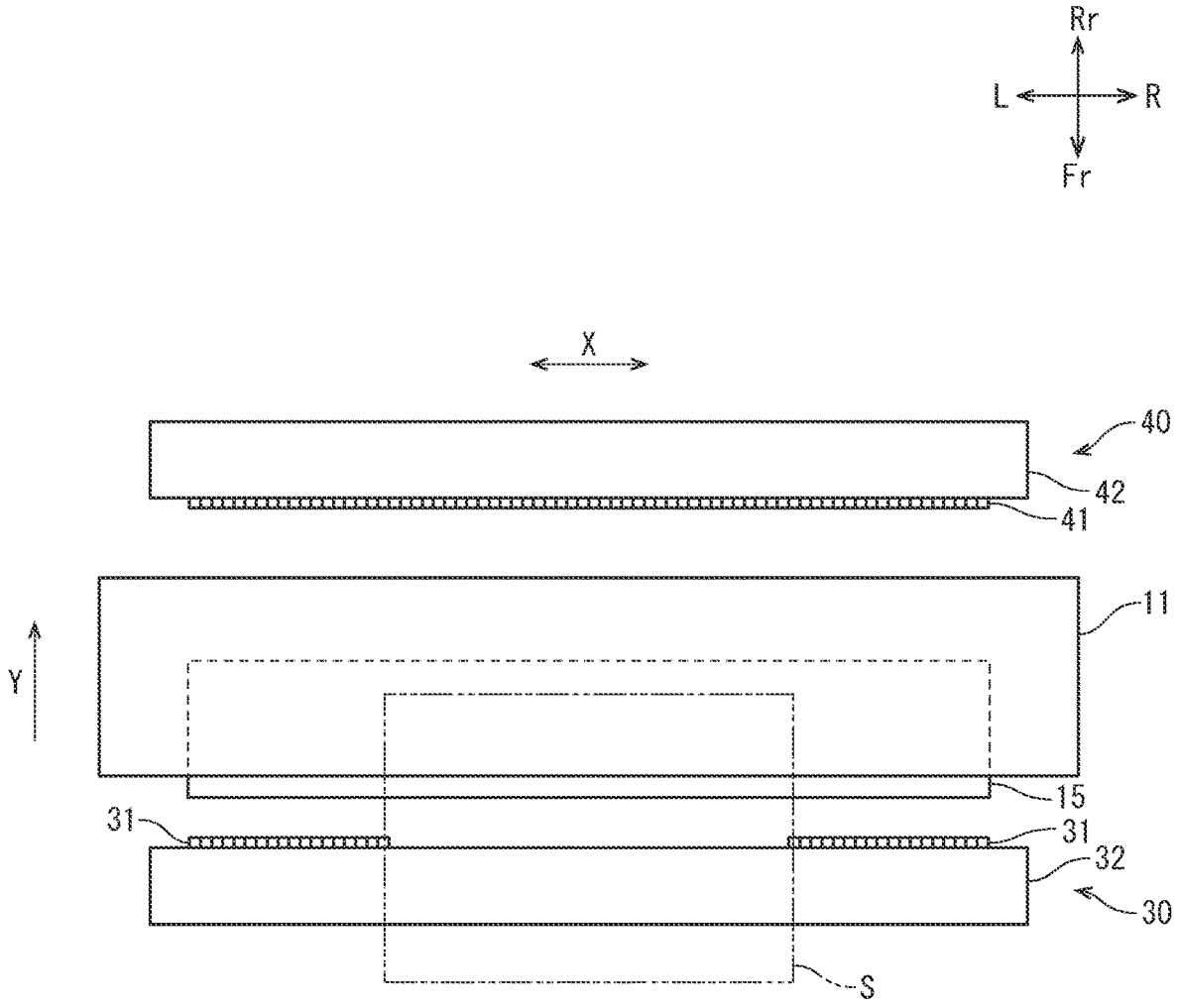
FIG. 11 is a plan view showing a first electricity eliminator according to the modified example of the embodiment of the present disclosure.

FIG. 11 is a plan view showing the first electricity eliminator 30 according to the modified example. In this example, the first electricity eliminator 30 includes the light sources 31 facing only the non-sheet passing area when the sheet S having the smallest length in the width direction X is conveyed. The sheet S having the smallest length in the width direction X is a sheet S of A6 size in which the long side is set perpendicular to the conveyance direction Y, for example. In this configuration, as in the above embodiment, the controller 2 controls the first electricity eliminator 30 so as to irradiate only when the sheet S having a length in the width direction X crossing the conveyance direction Y shorter than the transfer roller 15 is conveyed. According to this configuration, the manufacturing cost can be reduced.

The invention claimed is:

1. An image forming apparatus comprising:

a photosensitive drum provided on a conveyance path along which a sheet is conveyed;

a charging roller which charges the photosensitive drum;

a development device which develops an electrostatic latent image formed on the photosensitive drum charged by the charging roller;

a transfer roller which faces the photosensitive drum across the conveyance path and generates a transfer bias;

a first electricity eliminator which irradiates the photosensitive drum with light on a downstream side of the development device in a rotational direction of the photosensitive drum and on an upstream side of the transfer roller in the rotational direction; and a controller which controls the first electricity eliminator so as to irradiate only a non-sheet passing area of the photosensitive drum with the light, wherein the controller controls a quantity of light of the first electricity eliminator such that a potential of the non-sheet passing area of the photosensitive drum is lower than a potential of a non-image formed area of a sheet passing area before a transfer process by the transfer roller.

2. The image forming apparatus according to claim 1, wherein the first electricity eliminator has a plurality of light sources arranged in a width direction crossing a conveyance direction of the sheet along the conveyance path, and the controller turns on the light sources facing the non-sheet passing area corresponding to the conveyed sheet.

3. The image forming apparatus according to claim 2, wherein the light source is a LED.

4. The image forming apparatus according to claim 3, further comprising a light shielding member which blocks the light to the sheet passing area when the light source facing the non-sheet passing area is turned on.

5. The image forming apparatus according to claim 1, wherein the transfer roller has a length in a width direction crossing a conveyance direction of the sheet conveyed along the conveyance path longer than a maximum length of the sheet in the width direction.

6. The image forming apparatus according to claim 1, further comprising a second electricity eliminator which irradiates the photosensitive drum with light on a downstream side of a transfer position of the transfer roller in the rotational direction of the photosensitive drum and on an upstream side of the charging roller in the rotational direction, and a quantity of light of the first electricity eliminator is smaller than a quantity of light of the second electricity eliminator.

7. The image forming apparatus according to claim 6, wherein when a length of the sheet in a width direction crossing a conveyance direction of the sheet is shorter than a length of the transfer roller, the controller turns on the first electricity eliminator so as to irradiate only the non-sheet passing area with the light, and when the length of the sheet in the width direction is longer than the length of the transfer roller, the controller does not turn on the first electricity eliminator but turns on the second electricity eliminator.

* * * * *